US009379499B2

(12) United States Patent
Miyoshi et al.

(10) Patent No.: US 9,379,499 B2
(45) Date of Patent: Jun. 28, 2016

(54) CONNECTOR

(71) Applicant: HOSIDEN CORPORATION, Osaka (JP)

(72) Inventors: Toshiharu Miyoshi, Osaka (JP); Hayato Kondo, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 14/794,149

(22) Filed: Jul. 8, 2015

(65) Prior Publication Data

US 2016/0056593 A1 Feb. 25, 2016

(30) Foreign Application Priority Data

Aug. 22, 2014 (JP) ..... 2014-169051

(51) Int. Cl.
*H01R 24/00* (2011.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 23/7073; H01R 23/7005
USPC ..... 439/660, 626, 374, 377, 79, 733
See application file for complete search history.

(56) References Cited

U.S. PATENT DOCUMENTS 7,758,379 B2 * 7/2010 Chen ..... H01R 13/6485 439/607.11
2009/0156027 A1 6/2009 Chen
2009/0190277 A1 7/2009 Hiew et al.
2012/0214343 A1 8/2012 Buck et al.
2013/0330976 A1 12/2013 Simmel et al.
2014/0024257 A1 1/2014 Castillo et al.
2015/0044886 A1 * 2/2015 Little ..... H01R 12/75 439/55
2015/0072562 A1 * 3/2015 Little ..... H01R 13/6658 439/607.55

FOREIGN PATENT DOCUMENTS

JP H06-325826 11/1994

OTHER PUBLICATIONS

Search Report issued by E.P.O. patent office in E.P.O. Patent Application No. 15180861.5, dated Dec. 1, 2015.

* cited by examiner

*Primary Examiner* — Phuongchi T Nguyen

(74) *Attorney, Agent, or Firm* — Greenblum & Bernstein, P.L.C.

(57) ABSTRACT

A connector comprising: a first insulator substrate; a first contact configured by arranging a plurality of contact pins including contact pins for differential signals as an array, on a top surface of the first insulator substrate; a second insulator substrate; a second contact configured by arranging a plurality of contact pins including contact pins for differential signals as an array in the same direction as the array direction of the first contact, on an undersurface of the second insulator substrate; and a metal plate sandwiched by an undersurface of the first insulator substrate and a top surface of the second insulator substrate; and one or more holes are formed in an area on the metal plate, the area being sandwiched by the contact pins for differential signals of the first and second contacts facing each other.

2 Claims, 6 Drawing Sheets

CONNECTOR

TECHNICAL FIELD

The present invention relates to a connector for high-speed signal transmission.

BACKGROUND ART

In a conventional connector provided with a plurality of rows of contact pins (contacts), the size of the connector is sufficiently large. Therefore, in many cases, a distance between rows of contacts is sufficiently long, and differential signal contacts do not exist at overlapping positions. Thus, crosstalk among the contacts does not matter much. On the other hand, even if crosstalk among the contacts presents a problem, it is possible to suppress the crosstalk by causing a metal plate to intervene between contact rows (see Japanese Patent Application Laid-Open No. 06-325826, which will be hereinafter referred to as "Patent Literature 1").

In the case of using the connector of Patent Literature 1 as a connector for low-speed signal transmission, decrease in impedance caused by causing the metal plate to intervene does not matter. In the case of using a connector with a metal plate intervened between contact rows as in Patent Literature 1, as a connector for high-speed signal transmission, decrease in impedance presents a problem.

SUMMARY OF THE INVENTION

Therefore, an object of the present invention is to provide a connector for high-speed signal transmission capable of suppressing crosstalk and suppressing decrease in impedance.

A connector of the present invention comprises: a first insulator substrate; a first contact configured by arranging a plurality of contact pins including contact pins for differential signals as an array, on a top surface of the first insulator substrate; a second insulator substrate; a second contact configured by arranging a plurality of contact pins including contact pins for differential signals as an array in the same direction as the array direction of the first contact, on an undersurface of the second insulator substrate; and a metal plate sandwiched by an undersurface of the first insulator substrate and a top surface of the second insulator substrate. The contact pins for differential signals of the first contact and the contact pins for differential signals of the second contact are arrayed in the same order so as to face each other; and one or more holes in an arbitrary shape and with a size smaller than a circle having a diameter corresponding to one-fourth of the wavelength of the differential signals are formed in an area on the metal plate, the area being sandwiched by the contact pins for differential signals of the first and second contacts facing each other.

EFFECTS OF THE INVENTION

By a connector of the present invention, it is possible to suppress crosstalk and suppress decrease in impedance.

DETAILED DESCRIPTION

Figure 1:
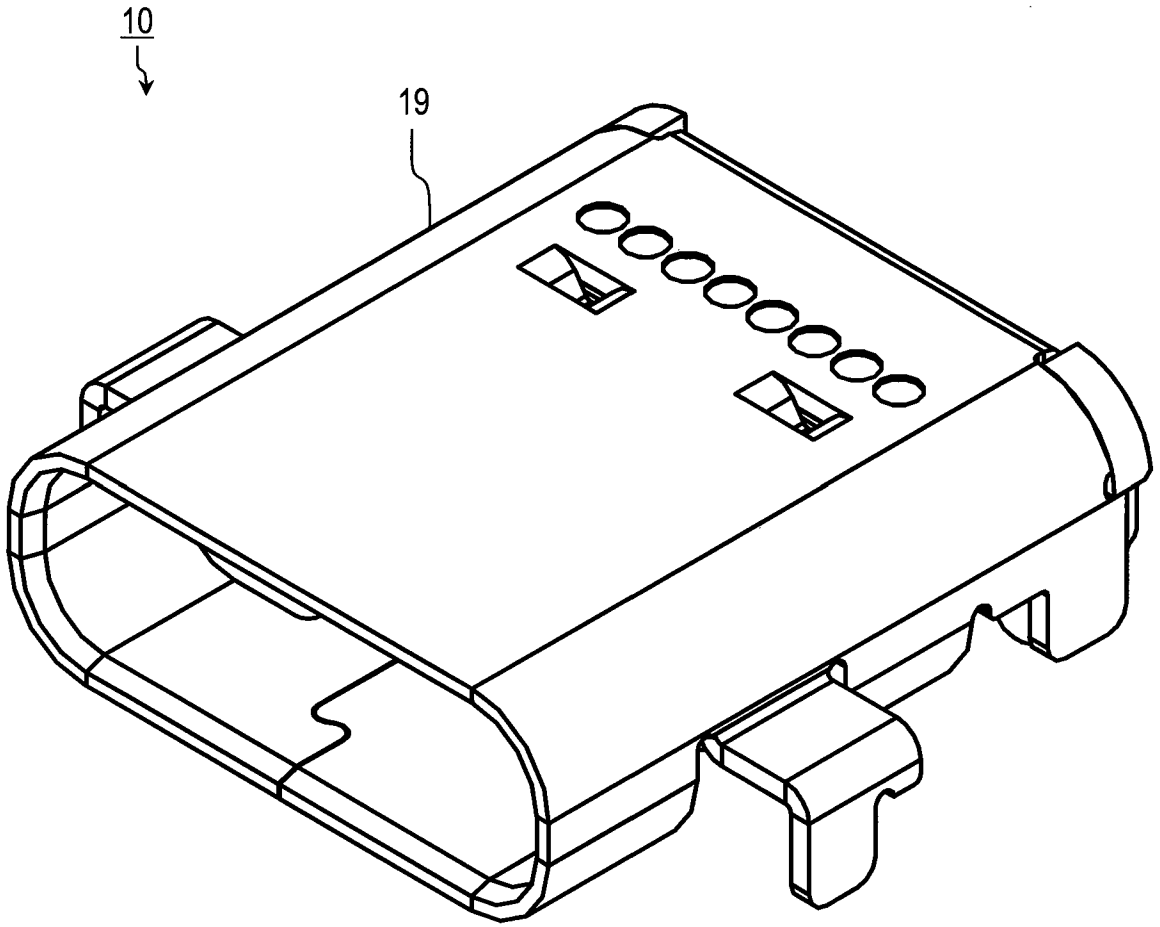
FIG. 1 is a perspective view (on a plane side) showing a connector of an embodiment of the present invention.

An embodiment of the present invention will be described below in detail. Components having the same function will be given the same reference numeral, and redundant description will be omitted.

Figure 2:
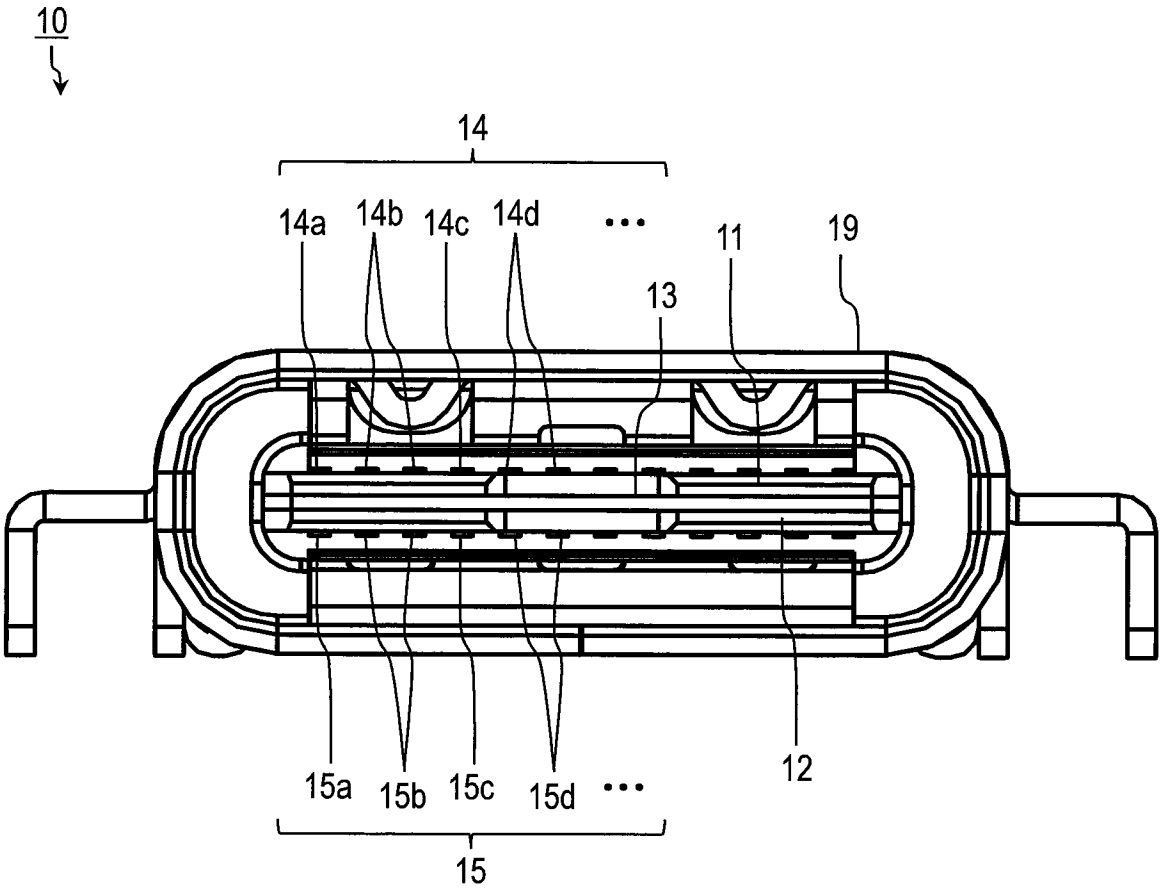
FIG. 2 is a front view showing the connector of the embodiment of the present invention.

A connector of the embodiment of the present invention will be described below with reference to FIGS. 1 and 2. FIG. 1 is a perspective view (on a plane side) showing a connector 10 of the present embodiment. FIG. 2 is a front view showing the connector 10 of the present embodiment. As shown in FIG. 1, the connector 10 of the present embodiment is provided with a case 19 covering the internal structure of the connector 10, with one end thereof open. A counterpart connector is inserted from the open end of the case 19, so that the counterpart connector and the connector 10 are connected and electrically connected. The case 19 is formed, for example, with metal. As shown in FIG. 2, there are provided inside the case 19: a first insulator substrate 11; a first contact 14 configured by arranging a plurality of contact pins including contact pins for differential signals as an array, on a top surface of the first insulator substrate 11; a second insulator substrate 12; a second contact 15 configured by arranging a plurality of contact pins including contact pins for differential signals as an array in the same direction as the array direction of the first contact 14, on an undersurface of the second insulator substrate 12; and a metal plate 13 sandwiched by an undersurface of the first insulator substrate 11 and a top surface of the second insulator substrate 12. In another expression, the first contact 14, the first insulator substrate 11, the metal plate 13, the second insulator substrate 12 and the second contact 15 are layeredly arranged inside the case 19 in that order from the top to form a sandwiched structure. Though the first insulator substrate 11, the second insulator substrate 12 and a hood 16 are integrally formed in the present embodiment, each of the first insulator substrate 11, the second insulator substrate 12 and the hood 16 may be formed as a separate body.

Figure 3:
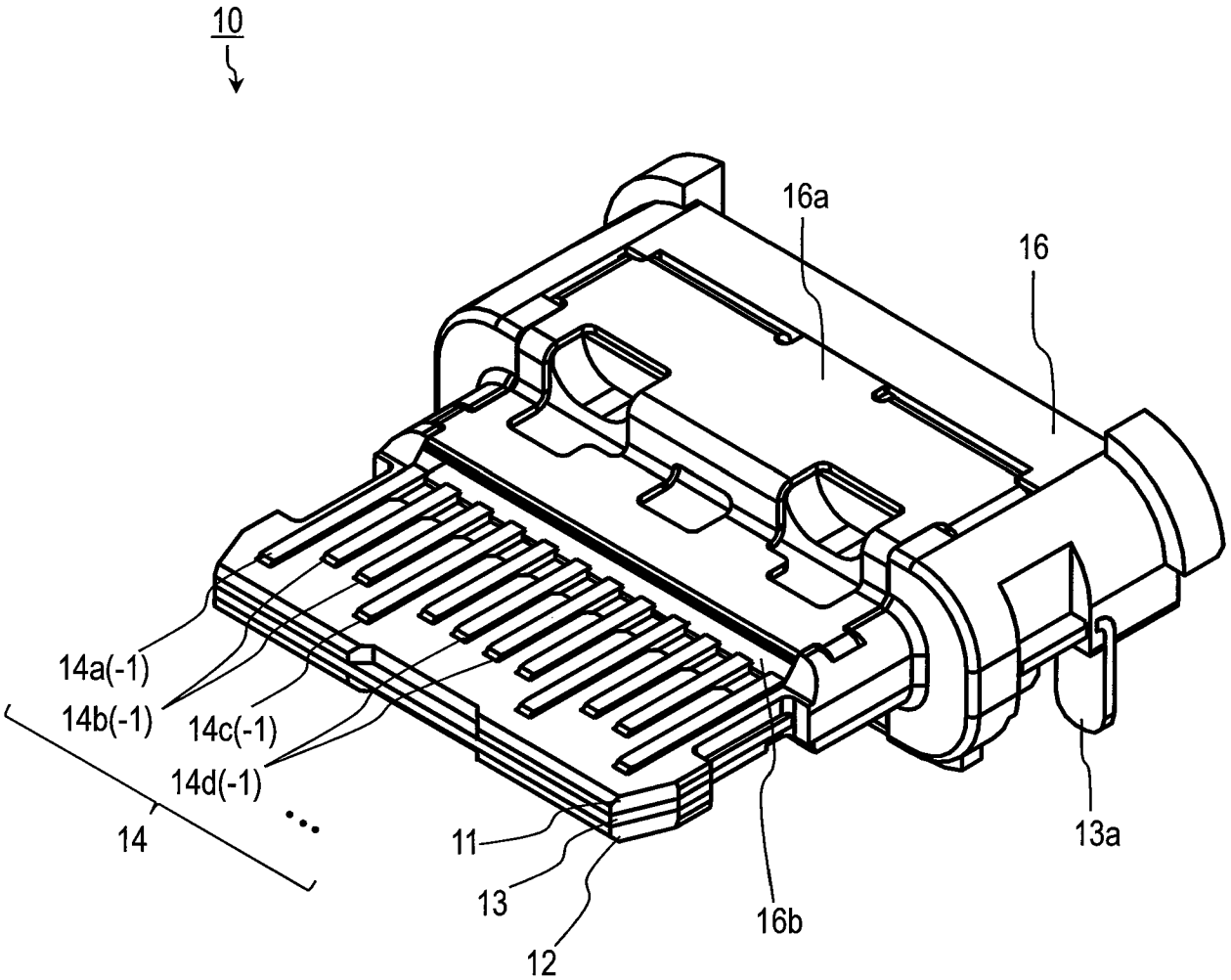
FIG. 3 is a perspective view (on the plane side) showing a state in which a case of the connector of the embodiment of the present invention has been removed.
Figure 4:
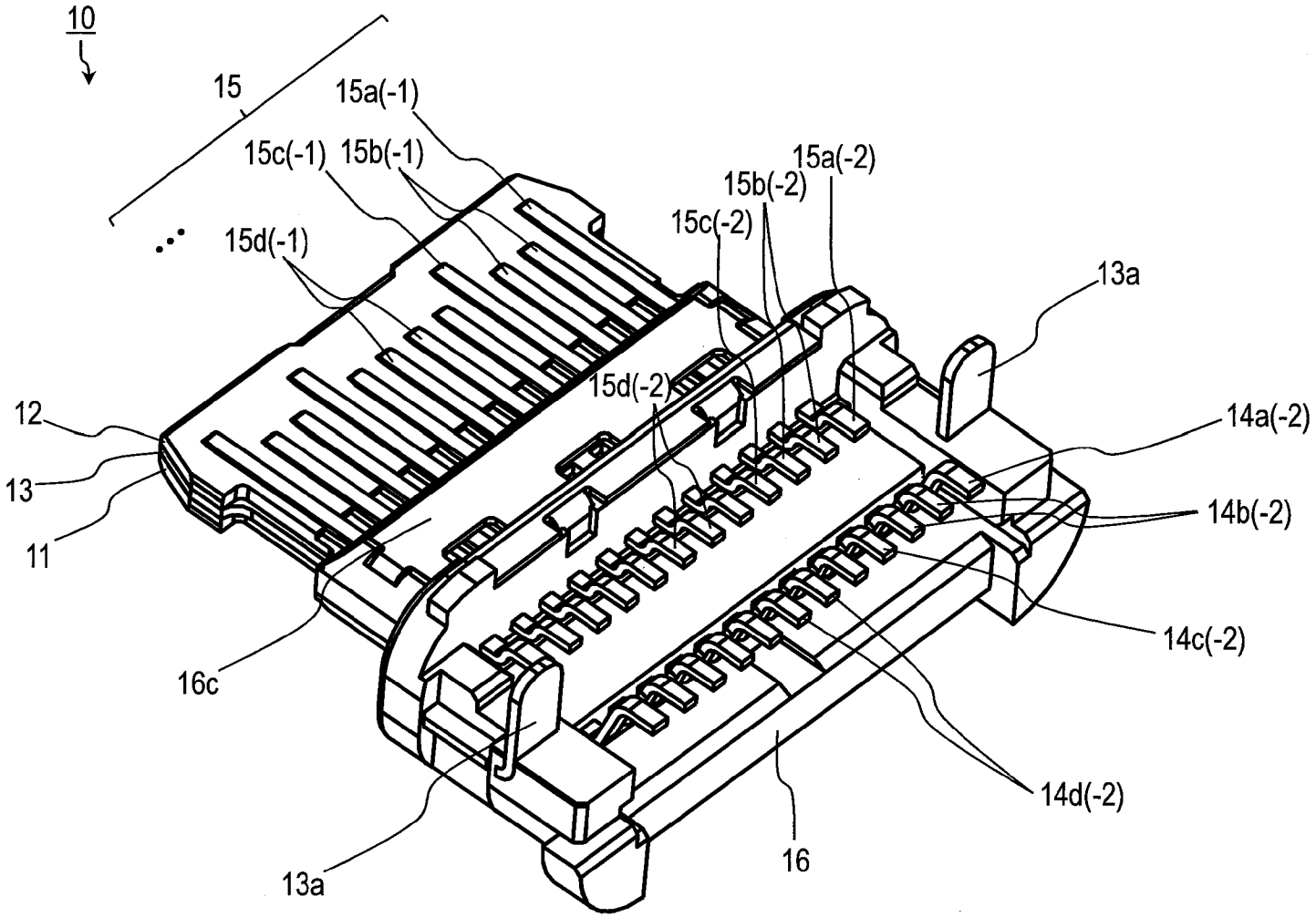
FIG. 4 is a perspective view (on a bottom side) showing the state in which the case of the connector of the embodiment of the present invention has been removed.

The internal structure of the connector 10 will be described below in detail with reference to FIGS. 3 and 4. FIG. 3 is a perspective view (on the plane side) showing a state in which the case 19 of the connector 10 of the present embodiment has been removed. FIG. 4 is a perspective view (on a bottom side) showing the state in which the case 19 of the connector 10 of the present embodiment has been removed. As shown in FIG. 3, one end side of each of the first insulator substrate 11, the second insulator substrate 12, the metal plate 13, the first contact 14 and the second contact 15 is included inside the hood 16 in a cylindrical shape with an almost elliptic section and the other end side is exposed from the hood 16. A removable top-surface cover 16*a* and an internal cover 16*b* are fitted on the top surface of the hood 16. Further, as shown in FIG. 4, a removal bottom-surface cover 16*c* is fitted on the bottom surface of the hood 16. For example, the hood 16 and the internal cover 16*b* may be made of resin, and the top-surface cover 16*a* and the bottom-surface cover 16*c* may be made of metal.

As shown in FIG. 3, the first contact 14 is provided with a first ground pin 14*a* which is a contact pin for ground; first differential signal pins 14*b* (two) which are contact pins for differential signals; a first power source pin 14*c* which is a contact pin for a power source; first low-speed signal pins 14*d* (four) which are contact pins for low-speed signals; a first power source pin 14*c*; two first differential signal pins 14*b*; and a first ground pin 14*a* which is a contact pin on the right end in that order from the left end. Thus, the first contact 14 is symmetrically configured.

Similarly, as shown in FIG. 4, the second contact 15 is provided with a second ground pin 15*a* which is a contact pin for ground; second differential signal pins 15*b* (two) which are contact pins for differential signals; a second power source pin 15*c* which is a contact pin for a power source; second low-speed signal pins 15*d* (four) which are contact pins for low-speed signals; a second power source pin 15*c*; two second differential signal pins 15*b*; and a second ground pin 15*a* which is a contact pin on the left end in that order from the right end. Thus, similarly to the first contact 14, the second contact 15 is symmetrically configured.

Thus, the first differential signal pins 14*b* and the second differential signal pins 15*b* are arrayed in the same order positions so as to face each other sandwiching the insulator substrates and the metal plate. In the present invention, the contact pins are not necessarily required to be arrayed in the order shown in FIGS. 3 and 4, and a different array order may be adopted. However, at least the contact pins for differential signals (14*b*) of the first contact 14 and the contact pins for differential signals (15*b*) of the second contact 15 are assumed to be arrayed in the same order positions so as to face each other.

The tip part on the other end side (the side exposed from the hood 16) of each of the contact pins of the first (second) contact 14 (15) is a part which gets in contact with the electrically connected part of a counterpart connector. Therefore, the tip part will be referred to as a contact part and expressed by adding a sign of 1 to the reference numeral of each of the contact pins. As shown in FIGS. 3 and 4, they are a contact part 14*a*-1 (15*a*-1) of the first (second) ground pin 14*a* (15*a*), contact parts 14*b*-1 (15*b*-1) of the first (second) differential signal pins 14*b* (15*b*), a contact part 14*c*-1 (15*c*-1) of the first (second) power source pin 14*c* (15*c*), and contact parts 14*d*-1 (15*d*-1) of the first (second) low-speed signal pins 14*d* (15*d*).

Further, as shown in FIG. 4, the tip part on one end side (the side included in the hood 16) of each of the contact pins of the first (second) contact 14 (15) projects from the bottom surface side of the hood 16. These will be referred to as leg parts, and a sign of 2 is added. For example, they are a leg part 14*a*-2 (15*a*-2) of the first (second) ground pin 14*a* (15*a*), leg parts 14*b*-2 (15*b*-2) of the first (second) differential signal pins 14*b* (15*b*), a leg part 14*c*-2 (15*c*-2) of the first (second) power source pin 14*c* (15*c*), and leg parts 14*d*-2 (15*d*-2) of the first (second) low-speed signal pins 14*d* (15*d*).

Figure 5:
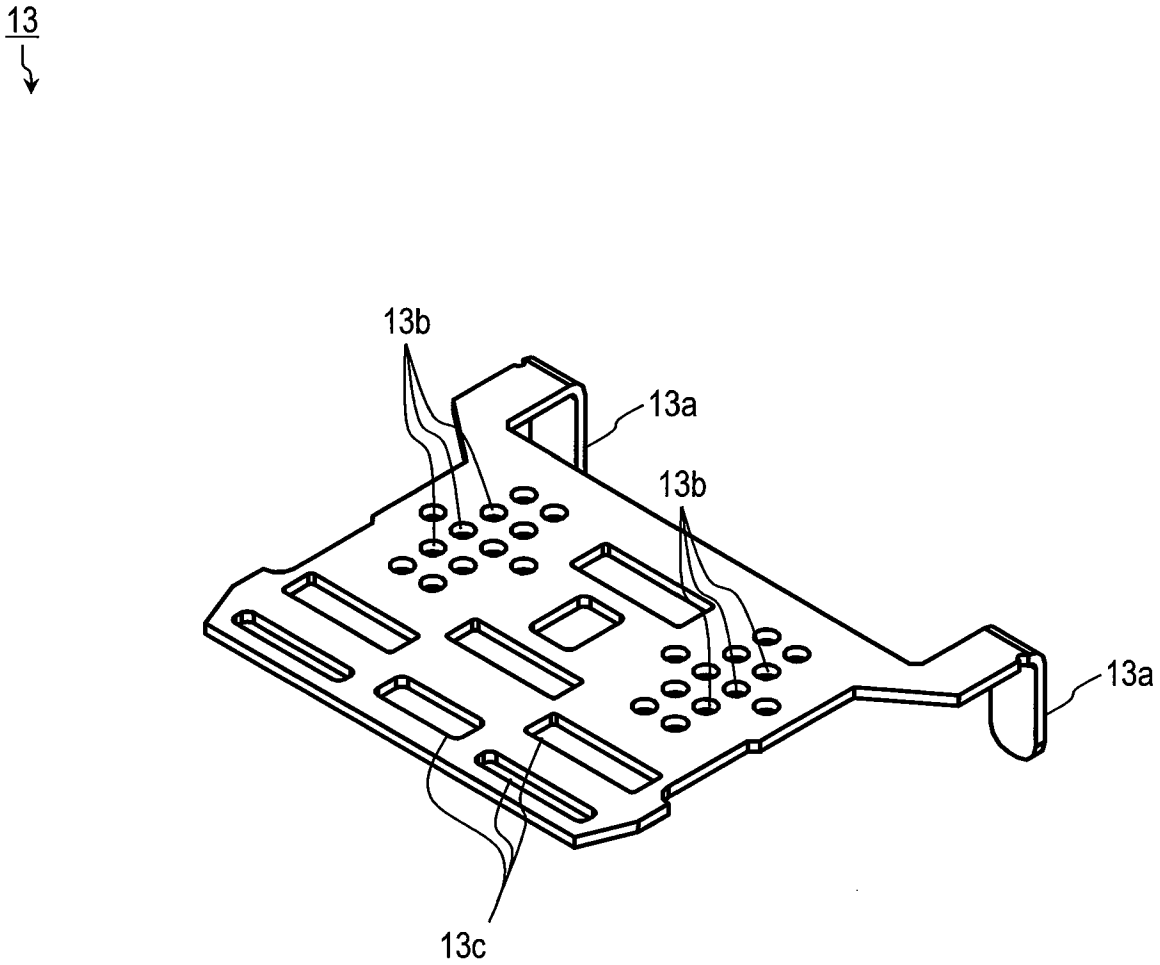
FIG. 5 is a perspective view (on the plane side) showing a metal plate of the connector of the embodiment of the present invention.

Next, the shape of the metal plate 13 will be described with reference to FIG. 5. FIG. 5 is a perspective view (on the plane side) showing the metal plate 13 of the connector 10 of the present embodiment. As shown in FIG. 5, the metal plate 13 is provided with a claw 13*a* folded and extended downward on each of the right and left ends of its one end side (on the side of the above-described leg part of each contact pin). The claws 13*a* project from the bottom surface of the hood 16 and are exposed (see FIGS. 3 and 4).

Holes 13*b* with a size smaller than a circle having a diameter corresponding to one-fourth of the wavelength of a differential signal are formed in an area on the metal plate 13, the area being sandwiched by the contact pins for differential signals (the first differential signal pins 14*b* and the second differential signal ping 15*b*) facing each other. The holes 13*b* may be in a circular shape, a square shape or a different shape. The holes 13*b* may be in any shape if the size is such that is included in the circle having the diameter corresponding to one-fourth of the wavelength of a differential signal which causes crosstalk. In the present embodiment, since the first differential signal pins 14*b* and the second differential signal pins 15*b* facing each other are provided such that each of the former and the latter is provided in two rows on each of the right and left sides. Therefore, the holes 13*b* are also provided in two rows in each of corresponding right and left areas on the metal plate 13. In the present embodiment, one hole 13*b* is also provided in each of an area sandwiched by the first ground pin 14*a* and the second ground pin 15*a* and an area sandwiched by the first power source pin 14*c* and the second power source pin 15*c*.

Further, long holes 13*c* are provided in the tip on the other end side (the side of the above-described contact part of each contact pin) and the central part of the metal plate 13. The long holes 13*c* are used to connect the first insulator substrate 11 and the second insulator substrate 12 or to fix each contact on each insulator substrate. The long holes 13*c* are not formed in an area where crosstalk presents a problem (an area sandwiched by the differential signal pins 14*b* and the differential signal pins 15*b* facing each other and positioned on the leg-part side of points of contact with a counterpart connector). In this area, only such holes 13*b* with a size smaller than the circle having the diameter corresponding to one fourth of the wavelength of a differential signal (214) can be provided.

Figure 6:
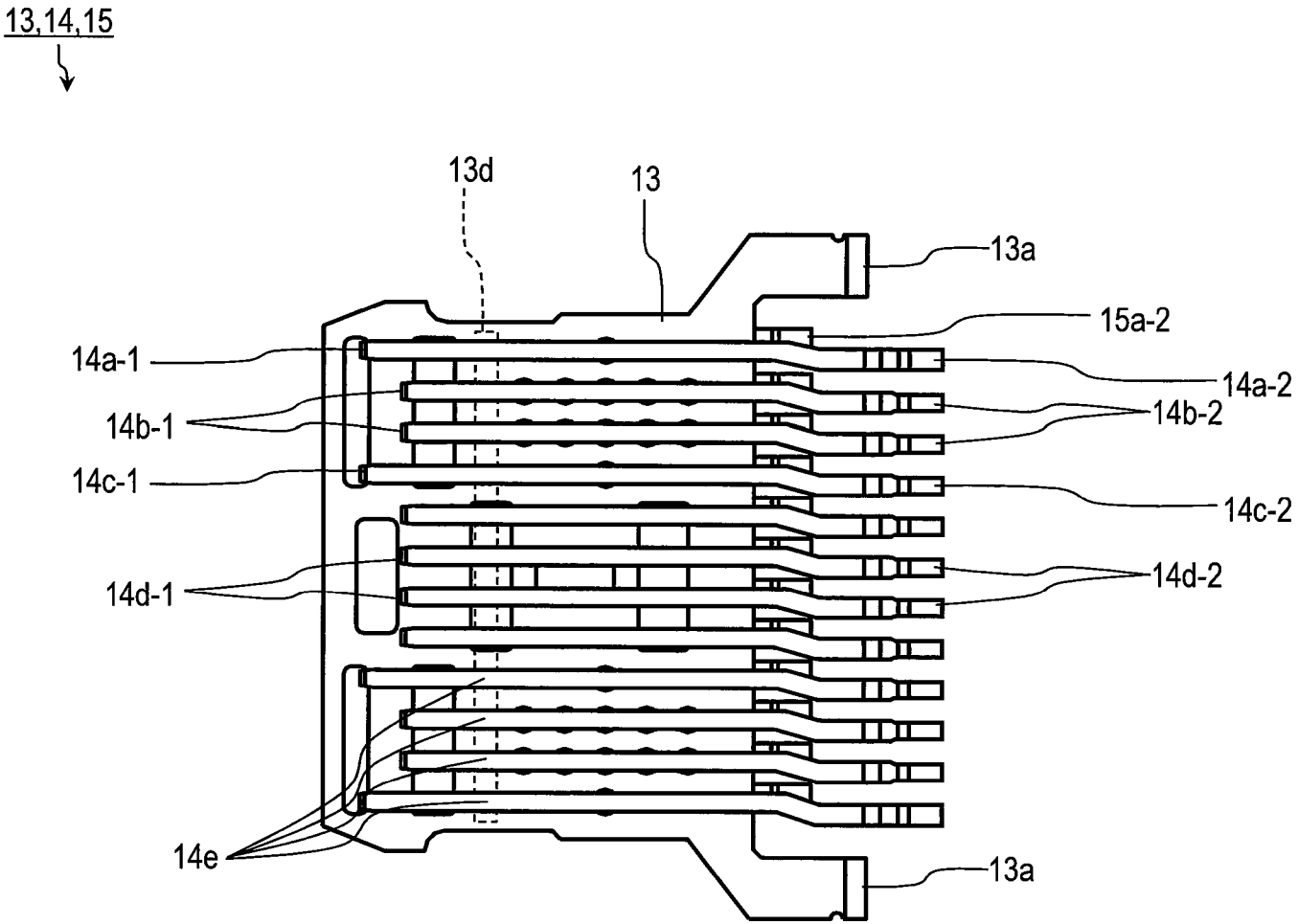
FIG. 6 is a plane view showing relative positions of the metal plate, first and second contacts and first contact points of the connector of the embodiment of the present invention.

Next, a relationship between the metal plate 13 and each contact will be described with reference to FIG. 6. FIG. 6 is a plane view showing relative positions of the metal plate 13, first and second contacts 14, 15 and first contact points 14*e* of the connector 10 of the present embodiment. Positions in the first contact 14 which come into contact with a contact of a counterpart connector when the connector 10 is engaged with the counterpart connector as shown in FIG. 6 will be referred to as the first contact points 14*e*. Similarly, positions in the second contact 15 which come into contact with a contact of the counterpart connector when the connector 10 is engaged with the counterpart connector will be referred to as second contact points 15*e* (not shown). If the holes 13*b* are formed in an area other than an area sandwiched by the first contact points 14*e* and the second contact points 15*e* (an area 13*d* near the contact points which is surrounded by a broken line in FIG. 6), it is more preferable. Therefore, it is preferable to provide the holes 13*b* in an area other than an area sandwiched by the first differential signal pins 14*b* and the second differential signal pins 15*b* and sandwiched by the first contact points 14*e* and the second contact points 15*e* (the area 13*d* near the contact points). As described before, the long holes 13*c* are arranged in an area other than the area where crosstalk presents a problem (the area on the leg-part side of the area 13*d* near the contact points, which is sandwiched by the first differential signal pins 14*b* and the second differential signal pins 15*b*).

As described above, in the connector 10 of the present embodiment, the holes 13*b* formed in the area sandwiched by the first differential signal pins 14*b* and the second differential signal pins 15*b* are formed in a size smaller than the circle having the diameter corresponding to $\lambda/4$ of a differential signal so as to prevent electromagnetic waves generated from the differential signal pins from passing through the holes 13*b*, and, therefore, crosstalk can be suppressed. Further, it is possible to suppress decrease in impedance caused by providing the metal plate 13, by the holes 13*b*. Further, by arranging the holes 13*b* in an area other than the area sandwiched by the points of contact with a counterpart connector (the first contact points 14*e* and the second contact points 15*e*), it is possible to offset increase in impedance caused by to the contact point structure and decrease in impedance caused by the metal plate 13 (it is known that impedance increases at a contact point part of a connector).

What is claimed is:

1. A connector comprising:

a first insulator substrate;

a first contact configured by arranging a plurality of contact pins including contact pins for differential signals as an array, on a top surface of the first insulator substrate;

a second insulator substrate;

a second contact configured by arranging a plurality of contact pins including contact pins for differential signals as an array in the same direction as the array direction of the first contact, on an undersurface of the second insulator substrate; and a metal plate sandwiched by an undersurface of the first insulator substrate and a top surface of the second insulator substrate; wherein the contact pins for differential signals of the first contact and the contact pins for differential signals of the second contact are arrayed in the same order so as to face each other; and one or more holes in an arbitrary shape and with a size smaller than a circle having a diameter corresponding to one-fourth of the wavelength of the differential signals are formed in an area on the metal plate, the area being sandwiched by the contact pins for differential signals of the first and second contacts facing each other.

2. The connector according to claim 1, wherein positions in the first and second contacts that come into contact with contacts of a counterpart connector when the connector is engaged with the counterpart connector are assumed as first contact points and second contact points, respectively; and the holes are formed in an area other than an area sandwiched by the first contact points and the second contact points.

* * * * *